US007268000B2

(12) United States Patent
Wollstein et al.

(10) Patent No.: US 7,268,000 B2
(45) Date of Patent: Sep. 11, 2007

(54) METHOD AND SYSTEM FOR CONTROLLING THE CHEMICAL MECHANICAL POLISHING OF SUBSTRATES BY CALCULATING AN OVERPOLISHING TIME AND/OR A POLISHING TIME OF A FINAL POLISHING STEP

(75) Inventors: Dirk Wollstein, Dresden (DE); Jan Raebiger, Dresden (DE); Gerd Marxsen, Radebeul (DE)

(73) Assignee: Advanced Micro Devices, Inc., Austin, TX (US)

( * ) Notice: Subject to any disclaimer, the term of this patent is extended or adjusted under 35 U.S.C. 154(b) by 1176 days.

(21) Appl. No.: 10/261,612

(22) Filed: Sep. 30, 2002

(65) Prior Publication Data

US 2003/0186546 A1 Oct. 2, 2003

(30) Foreign Application Priority Data

Feb. 26, 2002 (DE) ..... 102 08 165

(51) Int. Cl.
*H01L 21/00* (2006.01)
*H01L 21/66* (2006.01)

(52) U.S. Cl. ..... 438/5; 438/14; 438/692

(58) Field of Classification Search ..... 438/5, 438/14, 692

See application file for complete search history.

(56) References Cited

U.S. PATENT DOCUMENTS 6,230,069 B1 5/2001 Campbell et al. ..... 700/121
6,350,693 B2 * 2/2002 Chang et al. ..... 438/692
6,409,936 B1 * 6/2002 Robinson et al. ..... 252/79.1
6,492,273 B1 * 12/2002 Hofmann et al. ..... 438/692

FOREIGN PATENT DOCUMENTS

| | | |
|---|---|---|
| EP | 1 092 505 | 4/2001 |
| EP | 1 120 194 A2 | 8/2001 |
| JP | 10106984 A | 4/1998 |
| WO | WO98/14306 | 4/1998 |

OTHER PUBLICATIONS

Chamness et al., "A Comparison of R2R Control Algorithms for the CMP with Measurement Delays," AEC/APC XIII Symposium 2001.

* cited by examiner

*Primary Examiner*—Nadine G. Norton
*Assistant Examiner*—Lynette T. Umez-Eronini
(74) *Attorney, Agent, or Firm*—Williams, Morgan & Amerson, P.C.

(57) ABSTRACT

A method and a controller for the chemical mechanical polishing (CMP) of substrates and, in particular, for the chemical mechanical polishing of metallization layers is disclosed. In a linear model of the CMP process, the erosion of the metallization layer to be treated is determined by the overpolish time and possibly by an extra polish time on a separate polishing platen for polishing the dielectric layer, wherein the CMP inherent characteristics are represented by sensitivity parameters derived empirically. Moreover, the control operation is designed so that even with a certain inaccuracy of the sensitivity parameters due to subtle process variations, a reasonable controller response is obtained.

29 Claims, 4 Drawing Sheets

METHOD AND SYSTEM FOR CONTROLLING THE CHEMICAL MECHANICAL POLISHING OF SUBSTRATES BY CALCULATING AN OVERPOLISHING TIME AND/OR A POLISHING TIME OF A FINAL POLISHING STEP

BACKGROUND OF THE INVENTION

1. Field of the Invention

The present invention generally relates to the field of fabrication of integrated circuits, and, more particularly, to the chemical mechanical polishing (CMP) of material layers, such as metallization layers, during the various manufacturing stages of an integrated circuit.

2. Description of the Related Art

In the manufacturing of sophisticated integrated circuits, a huge number of semiconductor elements, such as field effect transistors, capacitors and the like, are fabricated on a plurality of chip areas (dies) that are spread across the entire surface of the substrate. Due to the ever-decreasing feature sizes of the individual semiconductor elements, it is necessary to provide the various material layers that are deposited on the entire substrate surface and that exhibit a certain topography corresponding to the underlying layers as uniformly as possible so as to ensure the required quality of subsequent patterning processes, such as photolithography, etching and the like. Recently, chemical mechanical polishing has become a widely used technique to planarize an existing material layer in preparation for the deposition of a subsequent material layer. Chemical mechanical polishing is of particular interest for the formation of so-called metallization layers, that is, layers including recessed portions such as vias and trenches filled with an appropriate metal to form metal lines connecting the individual semiconductor elements. Traditionally, aluminum has been used as the preferred metallization layer, and in sophisticated integrated circuits, as many as twelve metallization layers may have to be provided to obtain the required number of connections between the semiconductor elements. Semiconductor manufacturers are now beginning to replace aluminum with copper—due to the superior characteristics of copper over aluminum with respect to electromigration and conductivity. Through use of copper, the number of metallization layers necessary to provide for the required functionality may be decreased since, in general, copper lines can be formed with a smaller cross-section due to the higher conductivity of copper compared to aluminum. Nevertheless, the planarization of the individual metallization layers remains of great importance. A commonly used technique for forming copper metallization lines is the so-called damascene process in which the vias and trenches are formed in an insulating layer with the copper subsequently being filled into the vias and trenches. Thereafter, excess metal is removed by chemical mechanical polishing after the metal deposition, thereby obtaining planarized metallization layers. Although CMP is successfully used in the semiconductor industry, the process has proven to be complex and difficult to control, especially when a great number of large-diameter substrates are to be treated.

In a CMP process, substrates, such as the wafers bearing the semiconductor elements, are mounted on an appropriately formed carrier, a so-called polishing head, and the carrier is moved relative to the polishing pad while the surface of the wafer is in contact with a polishing pad. During this process, a slurry is supplied to the polishing pad, wherein the slurry contains a chemical compound that reacts with the material or materials of the layer to be planarized by, for example, converting the metal into an oxide, and the reaction product, such as copper oxide, is mechanically removed by abrasives contained in the slurry and the polishing pad. One problem with CMP processes arises from the fact that, at a certain stage of the process, different materials may be present on the layer to be polished at the same time. For example, after removal of the majority of the excess copper, the insulating layer material, for example silicon dioxide, as well as the copper and copper oxide, have to simultaneously be treated chemically and mechanically by the slurry, the polishing pad and the abrasives within the slurry. Usually, the composition of the slurry is selected to show an optimum polishing characteristic for a specified material. In general, the different materials exhibit different removal rates so that, for example, the copper and copper oxide are removed more rapidly than the surrounding insulating material. As a consequence, recessed portions are formed on top of the metal lines compared to the surrounding insulating material. This effect is usually referred to as "dishing." Moreover, during removal of the excess metal in the presence of the insulating material, the insulating material is also removed, although typically at a reduced removal rate compared to the copper, and thus the thickness of the initially deposited insulating layer is reduced. The reduction of the thickness of the insulating layer is commonly referred to as "erosion."

Erosion and dishing, however, not only depend on the differences in the materials that comprise the insulating layer and the metal layer, but may also vary across the substrate surface and may even change within a single chip area in correspondence with the pattern that is to be planarized. That is, the removal rate of the metal and the insulating material is determined based upon a variety of factors such as, for example, the type of slurry, the configuration of the polishing pad, structure and type of the polishing head, the amount of the relative movement between the polishing pad and the substrate, the pressure applied to the substrate while moving relatively to the polishing pad, the location on the substrate, the type of feature pattern to be polished, and the uniformity of the underlying insulating layer and of the metal layer, etc.

From the above considerations, it is evident that a plurality of interrelated parameters affect the topography of the finally-obtained metallization layer. Accordingly, a great deal of effort has been made to develop CMP tools and methods to improve the reliability and robustness of CMP processes. For example, in sophisticated CMP tools, the polishing head is configured to provide two or more portions that may exert an adjustable pressure to the substrate, thereby controlling the frictional force and thus the removal rate at the substrate regions corresponding to these different head portions. Moreover, the polishing platen carrying the polishing pad and the polishing head are moved relative to each other in such a way that as uniform a removal rate as possible is obtained across the entire surface area, and so that the lifetime of the polishing pad that gradually wears during operation is maximized. To this end, a so-called pad conditioner is additionally provided in the CMP tool that moves on the polishing pad and reworks the polishing surface so as to maintain similar polishing conditions for as many substrates as possible. The movement of the pad conditioner is controlled in such a manner that the polishing pad is substantially uniformly conditioned while, at the same time, the pad conditioner will not interfere with the movement of the polishing head.

Due to the complexity of CMP processes, it may be necessary to implement two or more process steps, preferably on different polishing platens, to obtain a polishing result that meets the strict requirements in the fabrication of cutting-edge semiconductor devices. For instance, in manufacturing a metallization layer, a minimum cross-section of the individual metal lines has to be established to achieve a desired resistance according to design rules. The resistance of the individual metal lines depends on the type of material, the line length and the cross-section. Although the two former factors do not substantially change during the fabrication process, the cross-section of the metal lines may significantly vary and thus influence the resistance and the quality of the metal lines owing to erosion and dishing created in the involved CMP process. Accordingly, semiconductor designers have to take these variations into account and implement an additional "safety" thickness of the metal lines such that the cross-section of each metal line is reliably within the specified tolerances after polishing operations are finished.

As is apparent from the above considerations, great efforts are being made to improve the yield in the chemical mechanical polishing of substrates while maintaining a high quality standard. Due to the nature of the CMP process, an in situ measurement of the thickness of the layer to be removed and/or of the removal rate is very difficult to predict. In practice, a plurality of dummy substrates are used to condition and/or calibrate the CMP tool before or after a predefined number of product substrates have been processed. Since the processing of dummy wafers is extremely cost-intensive and time-consuming, it has recently been attempted to significantly reduce the number of test runs by implementing suitable control mechanisms to maintain the performance of the CMP process. In general, it would be highly desirable to have a control process in which specific CMP parameters are manipulated on the basis of measurement results of the substrate that has just been processed in order to accurately maintain the final layer thickness and dishing and erosion within the specifications. To accomplish this co-called "run-to-run" control in the production line, at least two conditions have to be satisfied. First, appropriate metrology tools have to be implemented into the production line such that each substrate, having completed the CMP process, is immediately subjected to a measurement, the results of which have to be provided to the CMP tool prior to the CMP process or at least prior to the final stage of the CMP process of the substrate that immediately follows. Second, a model of the CMP process has to be established that reveals appropriate, manipulated variables to obtain the desired polishing results.

The first condition may not be fulfilled without significantly adversely affecting other parameters of the manufacturing process, such as throughput, and thus cost-effectiveness. Accordingly, in practice, a plurality of substrates are subjected to the CMP process until the first measurement result of the initially processed substrate is available. That is, the control loop contains a certain amount of delay that must be taken into consideration when adjusting the process parameters on the basis of the measurement results.

Regarding the second item, a plurality of CMP models have been established to take account for the fact that the manipulated variables are controlled on the basis of aged feedback results. For example, in the proceedings for the *AEC/APC VIII Symposium* 2001, "A Comparison of R2R Control Algorithms for the CMP with Measurement Delays," Chamness et. al. disclose the results of a comparison of three CMP models when operated under the condition of a delayed measurement feedback. In this paper, the authors showed that merely a model-predictive run control could avoid any instabilities in the control function when the measurement results are provided with a certain degree of delay to the CMP tool.

In view of this prior art, in general, a predictive model is desired such as the model described in the paper cited above and/or a set of experimental data to extract process variables, such as pressure applied to the substrate, slurry composition, etc., that may be manipulated to obtain the desired output of the CMP process.

Although CMP process control is successfully employed in many semiconductor facilities, from the considerations given so far, it is, however, apparent that a reliable and robust CMP process for sophisticated, integrated circuits involves great efforts in terms of process tools and control operations and it is thus highly desirable to have a simplified yet efficient CMP control process and control system, while also ensuring the required high quality standard of the processed substrates.

The present invention is directed to a method that may solve, or at least reduce, some or all of the aforementioned problems.

SUMMARY OF THE INVENTION

In general, the present invention is directed to a method and a controller that allow the control of a CMP process by manipulating a process parameter that is readily accessible, whereby the process-specific characteristics are described by an empirically determined parameter whose accuracy is, however, not critical for the proper control function.

Accordingly, in one illustrative embodiment of the present invention, a method of controlling the chemical mechanical polishing of substrates comprises empirically obtaining a first sensitivity parameter quantitatively describing a relationship between an overpolish time for a first material layer and a control variable related to the first material layer, and empirically obtaining a second sensitivity parameter quantitatively describing a relationship between the control variable related to a second material layer and a control variable related to a second material layer of a preceding substrate. Moreover, the method includes the calculation of the overpolish time of the first material layer from a linear model including the control variable related to the second material layer, the first sensitivity parameter, the second sensitivity parameter, a command value for the control variable, the overpolish time of the second material layer, the control variable of the second material layer and the control variable related to the second material layer of the preceding substrate, wherein the overpolish time is determined by a weighted moving average. Additionally, the overpolish time of the first material layer is adjusted to the calculated overpolish time.

According to a further illustrative embodiment, a method of controlling the chemical mechanical polishing of a first metallization layer in a substrate comprises empirically determining a sensitivity parameter $\alpha$ that quantitatively describes an effect of an overpolishing time $T_{op}$ on a control variable $E_{first}$ related to the first metallization layer. Moreover, a sensitivity parameter $\gamma$ is empirically determined that quantitatively describes an effect of the control variable $E_{second}$ of a second metallization layer of the substrate and of the control variable $E_{p,second}$ of the second metallization layer of the preceding substrate on the control variable $E_{first}$. Furthermore, the method comprises calculating the overpolish time $T_{op}$ for the first metallization layer from a linear model that at least includes the following terms: $E_{first}$, $E_{p,first}$, $\alpha(T_{op}-T_{p,op})$, $\gamma(E_{second}-E_{p,second})$, wherein $T_{p,op}$ is the overpolish time of the substrate. Additionally, the actual overpolish time of the chemical mechanical polishing process is adjusted to the calculated overpolish time $T_{op}$.

Pursuant to a further illustrative embodiment, a controller for the chemical mechanical polishing of substrates comprises an input section for entering at least one of a sensitivity parameter and a measurement value of a control variable, and an output section for outputting at least one of an overpolish time and a final polishing time as a manipulated variable. The controller further comprises a calculation section configured to calculate the overpolish time of a first material layer from a linear model, wherein the linear model includes the control variable related to a second material layer other than the first material layer, a first sensitivity parameter, a second sensitivity parameter, a command value for the control variable, the overpolish time of the second material layer, a control variable related to the second material layer, and the control variable of the second material layer of a preceding substrate. Moreover, the calculation section is configured to determine the manipulated variable by means of a weighted moving average.

According to a further illustrative embodiment, a controller for the chemical mechanical polishing of a first metallization layer in a substrate comprises an input section for entering a sensitivity parameter $\alpha$, a sensitivity parameter $\gamma$, and at least one measurement value of a control variable $E_{first}$, wherein the control variable $E_{first}$ represents one of erosion and dishing. Moreover, the controller comprises an output section for outputting at least an overpolish time $T_{op}$ as a manipulated variable to be used to control the chemical mechanical polishing. Additionally, the controller comprises a calculation section configured to at least calculate the overpolish time $T_{op}$ for the first metallization layer from a linear model of the CMP process. Thereby, the, linear model at least includes the following terms: $E_{first}$, $E_{p,first}$, $\alpha(T_{op}-T_{p,op})$, $\gamma(E_{second}-E_{p,second})$, wherein $E_{p,first}$ represents the control variable related to first metallization layer of a preceding substrate, $T_{p,op}$ represents the overpolish time of the preceding substrate, $E_{second}$ represents the control variable of a second metallization layer of the substrate and $E_{p,second}$ represents the control variable related to the second metallization layer of the preceding substrate.

BRIEF DESCRIPTION OF THE DRAWINGS

The invention may be understood by reference to the following description taken in conjunction with the accompanying drawings, in which like reference numerals identify like elements, and in which.

Figure 1:
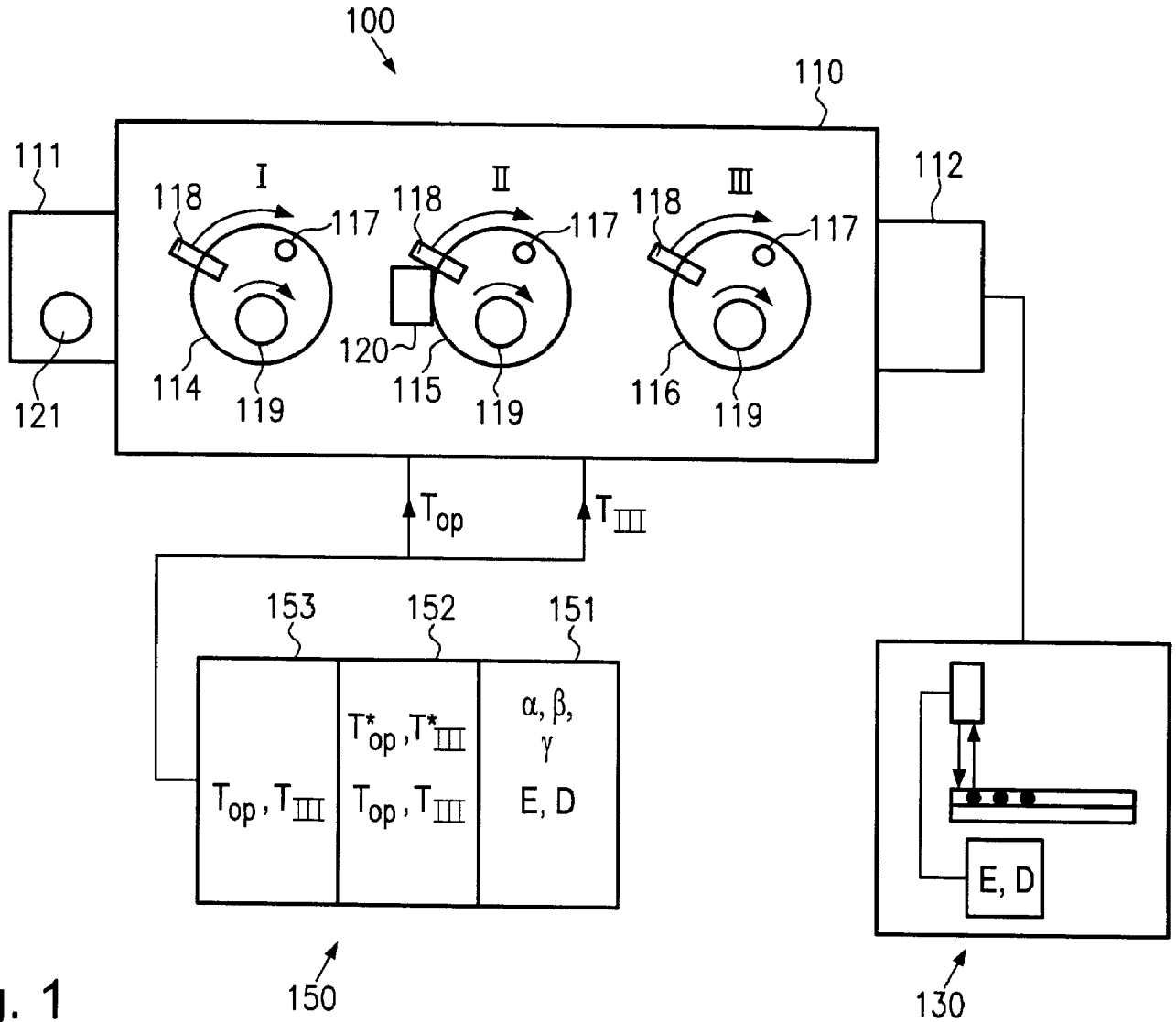
FIG. 1 shows a schematic diagram of an exemplary CMP tool, in which an illustrative embodiment of the present invention is implemented.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

In general, the embodiments described so far and the embodiments that will be described in the following are based on the finding that it is possible to maintain dishing and erosion of material layers in a substrate, such as metallization layers, within tightly set tolerances by appropriately adjusting the overpolish time in a CMP process. Commonly, the overpolish time indicates that time period for which the CMP process is continued after a measurement has indicated that the material is removed at a predefined region on the substrate. The process of detecting the clearance of a specified region is also referred to as endpoint detection and is usually employed in CMP processes used for manufacturing metallization layers. Moreover, as previously explained, the CMP process for damascene metallization layers in high-end integrated circuits is often designed as a multi-step process, where, for example, as the last step of the process, after the metal is removed, polishing operations are performed on the dielectric layer. Accordingly, by adjusting the process time of the final polishing step, the degree of erosion and dishing may be controlled. In order to reliably predict suitable overpolish times and/or process times of the final CMP step, the inventors suggest a linear model of the CMP process that is based on the erosion and/or the dishing and/or layer thickness of a previous metallization layer of the same and a preceding substrate. In this model, the process inherent mechanisms are expressed by two or more sensitivity parameters, which may be determined by experiment and/or calculation and experiment, wherein in some embodiments, the accuracy of the sensitivity parameters is not critical for a successful control operation due to a "self-consistent" design of the control function. Thus, contrary to a conventional control strategy as, for example, described in the background section of the application, in the present invention, readily accessible and precisely adjustable process parameters are selected as the manipulated variables of the control operation.

With reference to FIG. 1, a typical CMP tool and process is described that may be used with the illustrative embodiments described herein. In FIG. 1, a schematic view of a CMP system 100 is depicted, the system 100 comprising a CMP tool 110, a metrology tool 130 and a CMP controller 150. The CMP tool 110 includes an input portion 111 for receiving the substrate to be processed and an output portion 112 for receiving and storing substrates after the CMP process is completed. The CMP tool 110 further comprises a process chamber 113 including three polishing platens 114, 115 and 116, which are also referred to as platen I, platen II, and platen III, respectively. At each of the platens 114, 115, and 116, a pad conditioner 117, a slurry supply 118 and a polishing head 119 are provided. At platen II, a measurement means 120 is arranged and configured to detect the endpoint of a CMP process. For the sake of simplicity, any further means required for conveying substrates from the input portion 111 to platen I, or from platen I to platen II, and so on, as well as any means for feeding gases, liquids, such as water, slurry, and the like, are not depicted in the drawing.

In operation, a substrate 121, which comprises one or more metallization layers, is attached to the polishing head of platen I. It is to be noted that the substrate 121 represents a "current" substrate for which a manipulated variable of the control process to be described will be established, that is, the manipulated variable represents a process parameter whose value is varied so as to obtain the desired value of a control variable, such as dishing, erosion and the final layer thickness. A metallization layer of the substrate 121 that is to be immediately treated by the CMP tool 110 is also referred to as a first metallization layer, whereas any metallization layer of the substrate 121 underlying the first metallization layer and already subjected to the CMP process is referred to as a second metallization layer. Moreover, any substrate that has already been subjected to CMP is referred to as a preceding substrate and the metallization layers of the preceding substrate corresponding to the metallization layers of the current substrate 121 are also referred to as first and second metallization layers, as in the current substrate 121.

After the substrate 121 has completed the CMP process on platen I with predefined process parameters such as a predefined slurry composition, predefined relative movement between the polishing head 119 and the platen 114, duration of the CMP process, and the like, the substrate 121 is passed to platen II for a second CMP step, possibly with different process parameters, until the measurement device 120 indicates that the end of the process is reached. As previously explained, and as will be discussed in detail with reference to FIG. 2, the polishing of the substrate 121 is continued on platen II for an overpolish time $T_{op}$ that is determined by the controller 150. After the elapse of the overpolish time $T_{op}$, the substrate 121 is conveyed to platen III, where polishing of the insulating material of the first metallization layer is carried out with appropriate process parameters, such as slurry composition, relative movement between the platen 116 and the polishing head 119, bearing pressure applied to the substrate 121, and the like. In the embodiment shown in FIG. 1, the process time at platen III, also referred to as $T_{III}$, is determined by the controller 150. After the polishing step on platen III is completed, the substrate 121 is conveyed to the output portion 112 and possibly to the metrology tool 130, at which measurement results are obtained related to the first metallization layer, such as layer thickness, erosion and dishing. In various embodiments to be described, the layer thickness, erosion and dishing, alone or in combination, will be considered as control variables of the CMP process, whereas $T_{op}$ and/or $T_{III}$ will act as manipulated variables. Commonly, the measurement results of the control variables are obtained by well-known optical measurement techniques and the description thereof will therefore be omitted.

Figure 2:
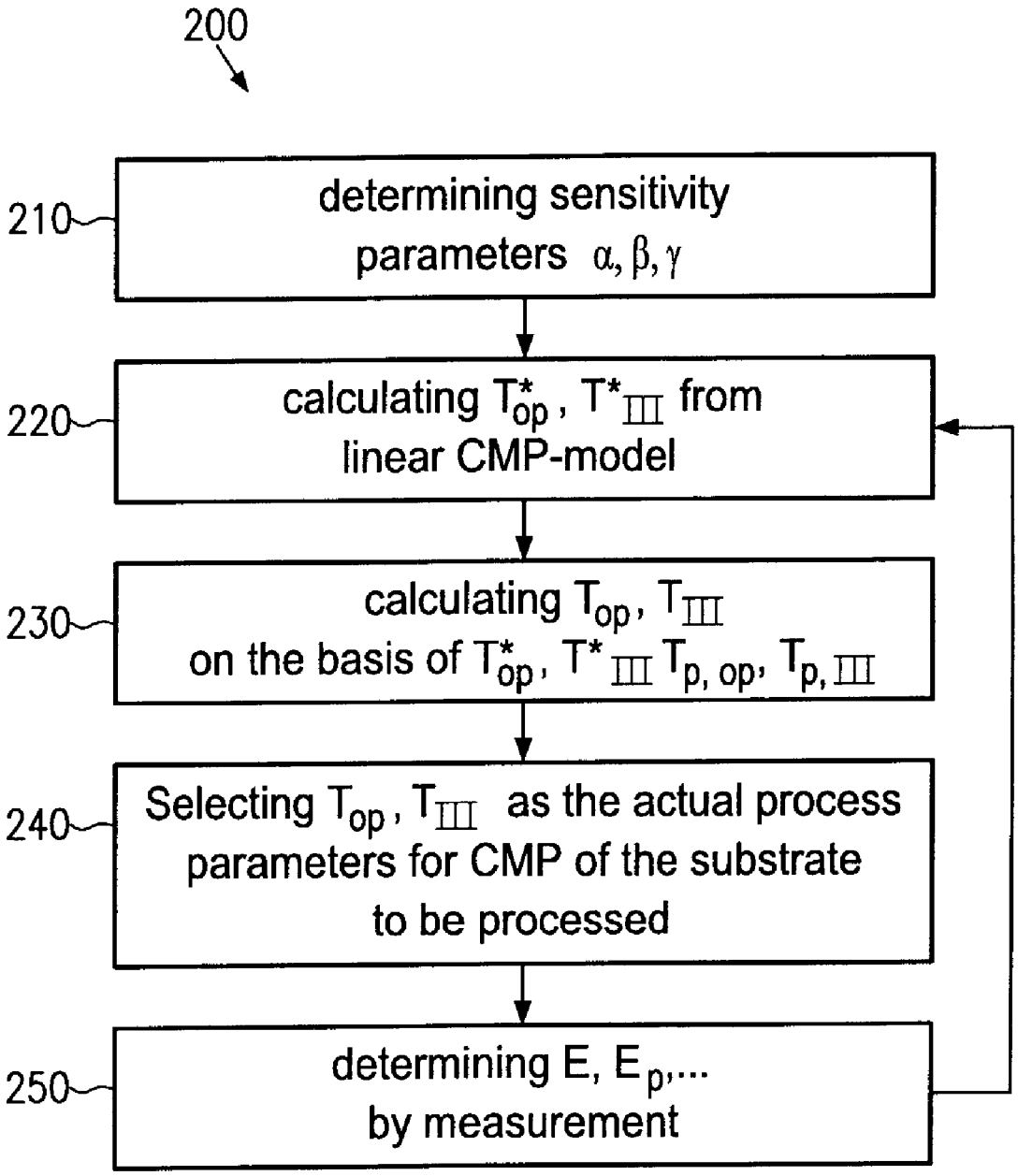
FIG. 2 depicts a flow chart representing one embodiment of the method for controlling the CMP.

With reference to FIG. 2, illustrative embodiments for obtaining the manipulated variables $T_{op}$ and $T_{III}$ will be described. In FIG. 2, in a first step 210, sensitivity parameters are determined which, in one embodiment, are obtained by experiment on the basis of previously processed test substrates or product substrates. A first sensitivity parameter $\alpha$ is thereby determined and describes the effect of the overpolish time $T_{op}$ on the control variable, e.g., the degree of erosion, dishing, metallization layer thickness, and the like. A second sensitivity parameter $\beta$ may also be determined specifying the influence of polish time $T_{III}$ of the CMP process performed on platen III on the control variable. Additionally, a third sensitivity parameter $\gamma$ is determined that quantitatively describes how the control variable of a preceding metallization layer, for example the dishing and/or erosion of the preceding layer, which will also be referred to as the second metallization layer as previously noted, influences the control variable of the current, i.e., the first metallization layer. In particular, the sensitivity parameters $\alpha$ and $\beta$ include the inherent CMP mechanisms, such as the removal rate, and thus may vary during the actual CMP process owing to, for example, degradation of the polishing pad, saturation of the slurry, and the like. In one particular embodiment, as will be described later on in detail, representing $\alpha$ and $\beta$ as single numbers for the benefit of a simple linear CMP model and thereby neglecting any variation of $\alpha$ and $\beta$ is taken into consideration by correspondingly designing the remaining control operations such that process-specific variations of $\alpha$ and $\beta$ will substantially not adversely affect the final result. In a further embodiment, in view of the subtle variation of the process conditions, the sensitivity parameters $\alpha$ and $\beta$ may be selected so as to depend on time, i.e., on the number of substrates that have already been processed or that are to be processed.

In step 220, intermediate values for the manipulated variables (referred to as $T_{op}$*, $T_m$*) are calculated from a linear CMP model. In this respect, a linear model is to be understood as a mathematical expression describing the relationship of various variables, such as the manipulated variables $T_{op}$, $T_{III}$ and the control variables, wherein the variables appear as linear terms without any higher order terms such as $T_{op}^2$, $T_{op}^3$, etc.

Figure 3:
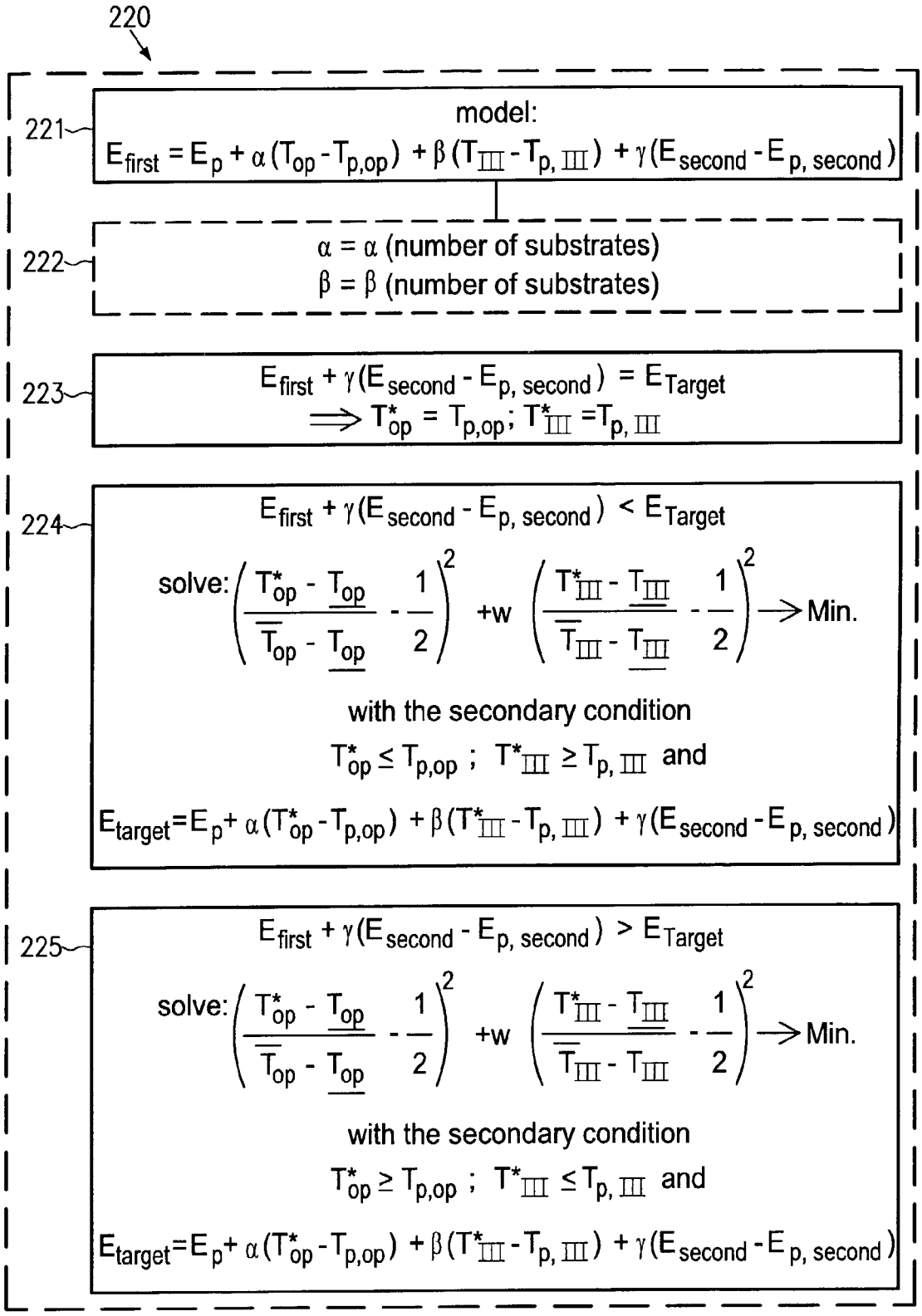
FIG. 3 is a flowchart representing details of the embodiments shown in FIG. 2.

With reference to FIG. 3, an illustrative embodiment for determining $T_{op}$* and $T_{III}$* will be described. In FIG. 3, step 220 is sub-divided into a first sub-step 221, depicting a linear model of the CMP process. According to this approach, the control variable of the first metallization layer is denoted $E_{first}$, wherein it should be borne in mind that a control variable may represent any one of erosion, dishing, metallization layer thickness and the like, and $E_{first}$ is given by the following equation:

$$E_{first}=E_{p,first}+\alpha(T_{op}-T_{p,op})+\beta(T_{III}-T_{p,III})+[\gamma](E_{second}-E_{p,second}) \quad (1)$$

wherein the index p indicates a variable referring to a preceding substrate and the index first and second, respectively, refer to the first metallization layer that is to be processed and the second metallization layer that has already been processed. Thereby, preferably the sign of $\alpha$ is selected as positive, whereas the sign of $\beta$ is selected to be negative. The magnitude and sign of $\gamma$ is determined by experiment. Moreover, as previously discussed, in one particular embodiment only a single manipulated variable, such as $T_{op}$, may be used to control the entire CMP process in cases where no final CMP step on platen III is used. As is apparent from equation 1, for a given $E_{p,first}$, e.g., the erosion of the first metallization layer, which may be obtained by measurement, increasing the overpolish time $T_{op}$ in the first metallization layer compared to the first metallization layer of the preceding substrate $T_{p,op}$ will increase $E_{first}$ by an amount that is determined by the difference of these overpolish times ($T_{op}-T_{p,op}$) multiplied by the sensitivity parameter $\alpha$. It is thus evident that a variation of the inherent mechanism of the CMP process represented by the single number a or a certain inaccuracy in determining a may influence the result of $E_{first}$ and could therefore create a value for $T_{op}$ that may in some cases be considered inappropriate for obtaining a desired $E_{target}$, where $E_{target}$ is the target value for the control variable. The same is true for the sensitivity parameter β.

Accordingly, in one embodiment, as previously mentioned, in sub-step 222 the parameters α and β may be selected as time-dependent parameters or, more appropriately, as parameters depending on the number of substrates to be processed. In this way, the general tendency of degradation of the polishing pad, the slurry composition and the like may be taken into account so that systematic variations in α and/or β may be compensated for. That is, a systematic reduction of the polishing rate over time may be taken into account by correspondingly increasing α and/or decreasing β as the number of processed substrates increases. Thus, α and/or β may be selected as functions α=α(i) and/or β=β(i), wherein (i) represents the number of processed substrates. This characteristic imparts a certain degree of predictability to the CMP control, which may be advantageous when, as previously explained, the controller has to respond to measurement results possibly having a significant delay with respect to the currently processed substrate.

In sub-step 223, intermediate values for the manipulated variables overpolish time and polish time on platen III are obtained in correspondence with the model of step 221. The reason for determining the intermediate variables $T_{op}^*$, $T_{III}^*$ resides in the fact that the control operation should "smooth" any short fluctuations in the CMP process and should respond to measurement results of previously processed substrates in a "soft" manner without showing excessive undershootings and overshootings. This behavior of the control operation may be convenient when only a small number of measurement results per substrate is available so that the measurement results from one preceding substrate to another preceding substrate may show a significant fluctuation. That is, the measurement result representing, for example, $E_{p,first}$ is obtained by a single measurement of a predefined single location on the preceding substrate. Thus, prior to the actual manipulated variables $T_{op}$, $T_{III}$, the intermediate manipulated variables $T_{op}^*$ and $T_{III}^*$ are determined.

In sub-step 223 for the case when $$E_{p,first}+\gamma(E_{second}-E_{p,second})=E_{target} \tag{2}$$

This means the command value $E_{target}$ is obtained without changing the overpolish time compared to the overpolish time of the preceding substrate and without changing the polish time on platen III compared to the polish time on platen III of the previous substrate. Consequently, $T_{op}^*$ is equal to $T_{p,op}$ and $T_{III}^*$ is equal to $T_{p,III}$.

In sub-step 224 $T_{op}^*$ and $T_{III}^*$ are calculated for the case:

$$E_{p,first}+\gamma(E_{second}-E_{p,second})<E_{target} \tag{3}$$

That means the erosion and/or dishing and/or layer thickness, depending on what E actually represents, of the first metallization layer of the preceding substrate and the effect of the erosions of the second metallization layer of the current substrate and the preceding substrate result in a smaller erosion and/or dishing and/or layer thickness than desired. Evidently, the overpolish time for the current substrate has to be equal or larger than the overpolish time of the preceding substrate and the polish time on platen III has to be equal or less than the polish time of the preceding substrate. Thus, $$T_{op}^*\geqq T_{p,op};T_{III}^*\leqq T_{p,III} \tag{4}$$

Moreover, in general, a maximum and a minimum overpolish time $\overline{T_{op}}$, $\underline{T_{op}}$ and a maximum and a minimum polish time on platen III $\overline{T_{III}}$, $\underline{T_{III}}$ may be set in advance, corresponding to process requirements. These limits for the overpolish time and the platen m polish time may be determined by experiment or experience. For example, the maximum and minimum overpolish times $\overline{T_{op}}$, $\underline{T_{op}}$, respectively, may be selected to approximately 30 seconds and 5 seconds, respectively. The maximum and minimum polish times on platen III $\overline{T_{III}}$, $\underline{T_{III}}$, respectively, may be selected to approximately 120 seconds and 20 seconds, respectively. In the embodiment in which the overpolish time $T_{op}$ and the platen III polish time $T_{III}$ are simultaneously used as manipulated variables, it is desirable to determine the intermediate values $T_{op}^*$ and $T_{III}^*$ such that the values are well within the allowable ranges given by the minimum and maximum overpolish times and platen III polish times, respectively. In one embodiment, the intermediate overpolish time $T_{op}^*$ and platen III polish time $T_{III}^*$ are determined to be centered around the middle of the corresponding allowable range, wherein at the same time $T_{op}^*$ and $T_{III}^*$ have to be selected such that the CMP model provides the command value $E_{target}$, thus $T_{op}^*$ and $T_{III}^*$ are determined by:

$$E_{p,first}+\alpha(T_{op}^*-T_{p,op})+\beta(T_{III}^*-T_{p,III})+\gamma(E_{second}-E_{p,second})=E_{target} \tag{5}$$

$T_{op}^*$ and $T_{III}^*$ that are centered in the respective allowable ranges may be obtained by calculating a minimum of the following expression:

$$\left(\frac{T_{op}^*-T_{op}}{\overline{T_{op}}-\underline{T_{op}}}-\frac{1}{2}\right)^2+w\left(\frac{T_{III}^*-T_{III}}{\overline{T_{III}}-\underline{T_{III}}}-\frac{1}{2}\right)^2\rightarrow \text{Minimum} \tag{6}$$

wherein the equations 4 and 5 are accordingly secondary conditions for finding the minimal $T_{op}^*$ and $T_{III}^*$.

In a similar way, in sub-step 225 $T_{op}^*$ and $T_{III}^*$ are calculated for the case:

$$E_{p,first}+\gamma(E_{second}-E_{p,second})>E_{target} \tag{7}$$

This means that the erosion of the first metallization layer of the preceding substrate and of the second metallization layers in combination exceed the desired erosion value. Thus, the intermediate overpolish time has to be selected equal or less to the overpolish time of the preceding substrate and the intermediate platen III polish time has to be selected equal or greater than the platen III polish time of the preceding substrate. Consequently, $$T_{op}^*\leqq T_{p,op};T_{III}^*\geqq T_{p,III} \tag{8}$$

Analogous to the calculations performed in sub-step 224, also in this case a minimum of the expression (6) is determined with the secondary condition (5) and (8).

To qualitatively summarize the above sub-steps for obtaining the intermediate overpolish time $T_{op}^*$ and the intermediate platen III polish time $T_{III}^*$, it is to be noted that when the measurement results of the preceding substrate in the second metallization layer or, respectively, the calculated values therefor, indicate that the expected erosion is equal to the desired erosion, then the intermediate overpolish time $T_{op}$* and platen III polish time $T_{III}$* correspond to the overpolish time $T_{p,op}$ and platen III polish time $T_{p,III}$ of the preceding substrate. For the cases where the erosion values for the preceding substrate and the second metallization layers of the current substrate 221 and the preceding substrate do not yield to the desired erosion $E_{target}$, the intermediate polish times are determined such that the values are centered around the middle of the allowable ranges while, at the same time, fulfilling the secondary conditions (5) and (6), i.e., the intermediate polish times must yield to the desired erosion $E_{target}$ and must also obey the conditions (4) and (8). In particular, the secondary conditions (4) and (8) ensure that any shift of $T_{op}$* is not compensated by a corresponding change of the platen III polish time. A corresponding behavior might possibly lead to a simpler solution in determining the minimal values according to (6), but could, however, result in a control operation in the wrong direction for inaccurate parameters α and β and thus destabilize the control function.

It is to be understood that in practice the calculations may be performed with a predefined precision and, thus, any statement regarding the solving of equations is, of course, subject to a certain degree of "variation," depending on the algorithms and the tolerable degree of "impreciseness." Therefore, the results of calculations described herein are to usually be taken as approximate numbers, with the degree of approximation being determined by factors such as available computational power, required accuracy and the like. For example, in many applications, a precision in the order of one second for the overpolish time and the platen III time is sufficient, since a polishing activity within a second leads to a change in erosion of an amount that may be well within measurement fluctuations.

The weighting factor in determining the minimal value in the expression (6) may be selected as:

$$w = \left(\frac{\overline{T_{III}}}{\overline{T_{op}}} - \frac{\underline{T_{III}}}{\underline{T_{op}}}\right)\frac{|\beta|}{|\alpha|}$$

The weighting factor w may also be determined on an empirical basis.

Moreover, it should be noted that the determination of the intermediate values by calculating the minimum values is not required when merely one manipulated variable, for example the overpolish time $T_{op}$, is used.

Again, referring to FIG. 2, in step 230 the actual output values for the overpolish time and the platen III polish time are calculated from the intermediate overpolish time and the intermediate platen III polish time and the overpolish time and platen III polish time of the preceding substrate. This ensures, depending on the algorithm used, a relatively smooth adaptation of the overpolish time and the platen III polish time to the "evolution" of the overpolish time and the platen III polish time of preceding substrates.

Figure 4:
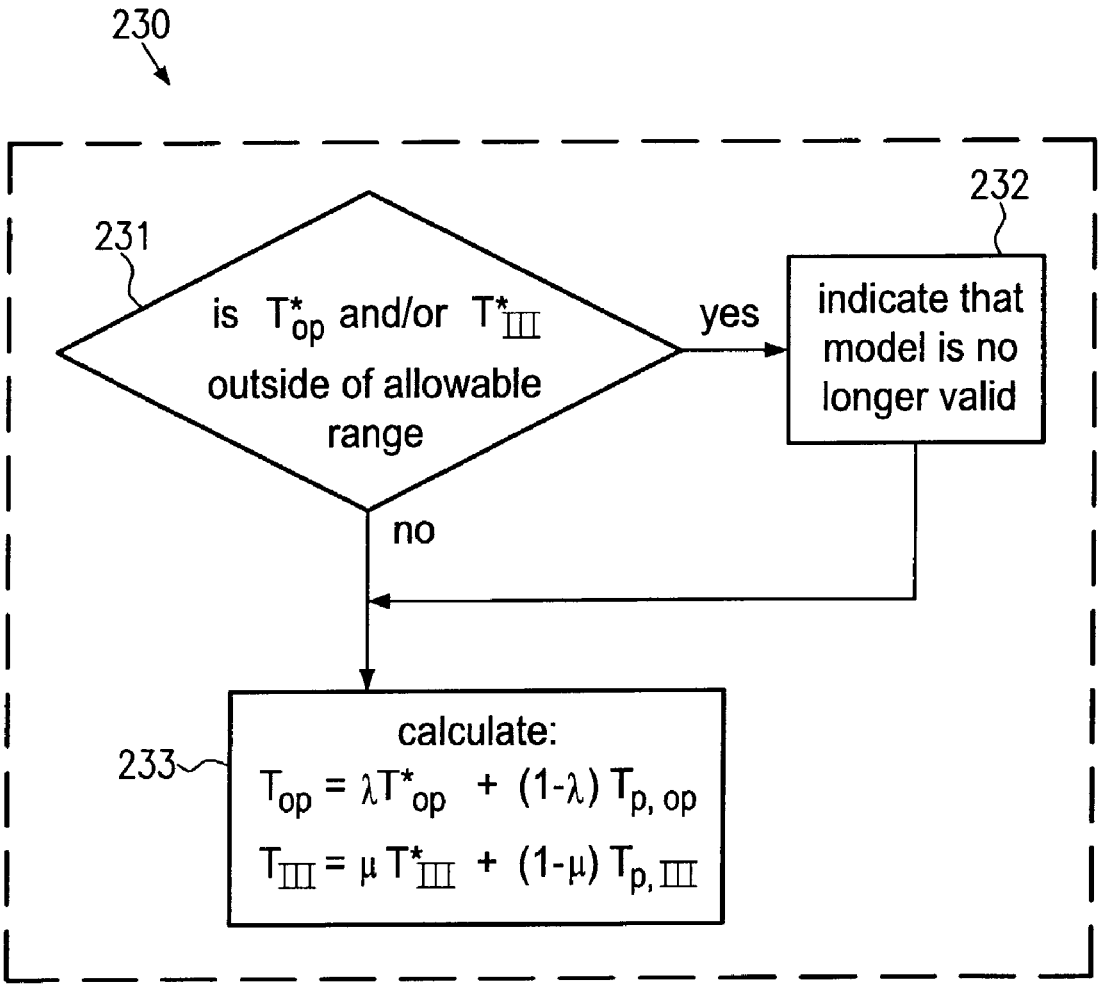
FIG. 4 is the flowchart illustrating further details in calculating the manipulated variable according to the embodiment shown in FIG. 2.

Referring to FIG. 4, one illustrative embodiment is shown for obtaining the overpolish time and the platen III polish time in step 230. In a first sub-step 231, it may be checked whether or not $T_{op}$* and/or $T_{III}$* are within predefined ranges that may be different from the ranges defined by the minimum and maximum overpolish times and platen III polish times. By these predefined ranges, it may be detected whether or not there is a tendency that the control operation systematically moves out of a well-defined range indicating that the parameters α and β, and thus the CMP conditions, have changed significantly.

In this case, in sub-step 232, it may be indicated that the linear model of the CMP process is no longer valid or may become invalid in the "near future" of the CMP process run under consideration. This indication is to be taken as evidence that any unforeseen change of the CMP inherent mechanisms has taken place. It is to be noted that the sub-step 231 is optional and may be omitted.

In sub-step 233, the overpolish time and the platen III polish time are calculated by means of a weighted moving average from the overpolish time of the preceding substrate and the intermediate overpolish time $T_{op}$*, and the platen III polish time is calculated as a weighted moving average from the platen III polish time of the preceding substrate and the intermediate platen III polish time $T_{III}$*. As depicted in 233, the overpolish time $T_{op}$ is given by:

$$T_{op}=\lambda T_{op}^{*}+(1-\lambda)T_{p,op}$$

wherein λ is a parameter in the range of 0-1. By means of the parameter λ, the "speed" of adaptation of the control swing with respect to the foregoing development of the overpolish times may be adjusted. Similarly, the platen III polish time may be obtained by:

$$T_{III}=\mu T_{III}^{*}+(1-\mu)T_{p,III}$$

wherein the parameter μ adjusts the speed of adaptation of the platen III polish time with respect to the preceding substrates. Evidently, a value for λ and μ close to 1 results in an immediate response of the overpolish time and the platen III polish time when, for example, a measurement result of the preceding substrate indicates a relatively large deviation from the command value $E_{target}$. On the other hand, electing λ and μ as relatively low values would result in only a very slow response to any changes in the CMP process. In one particular embodiment, an algorithm referred to as exponentially weighted moving average (EWMA) is employed, wherein the same λ values are used for the overpolish time and the platen III polish time. With this EWMA model, the effect of the most recent progress of the CMP process may be taken into account more effectively than any "aged" process events. A corresponding embodiment including the EWMA is especially suited when no significant delay of the measurement results from the preceding substrate is present, that is, only few or none substrates have been processed between the current substrate 121 and the preceding substrate.

Again, with reference to FIG. 2, in step 240 the overpolish time and the platen III time calculated in step 230 are transmitted to the CMP tool 110 in FIG. 1 to adjust the corresponding process times of the substrate 121 that is currently processed.

In step 250, the substrate is conveyed to the metrology tool 130 to obtain measurement values for the control variable. These measurement results may then serve as $E_{second}$, $E_{p,second}$, $E_p$ for the calculation for a following substrate. As previously discussed, there may be a certain degree of delay until the measurement results are available for the controller 150 and, in this case, advantageously the embodiment described with reference to sub-step 222 may be used in which the sensitivity parameters α and β are given as parameters depending on the number of substrates that have been processed and that are to be processed, since then the controller 150 shows a "predictive" behavior and may output reliable values for the overpolish time and the platen III polish time even for a considerable delay in the control loop. Moreover, the number of measurement operations may be significantly reduced when such a predictive model is employed.

In the embodiments described so far, the substrate currently to be processed and the preceding substrate are referred to as single substrates, but, in one illustrative embodiment, the current substrate and the preceding substrate may represent a plurality of substrates, such as a lot of substrates, wherein the control variables $E_{first}$, $E_{p,first}$, $E_{second}$, $E_{p,second}$ and the manipulated variables $T_{op}$ and $T_{III}$ represent the mean values for the corresponding plurality of substrates. A corresponding arrangement has been proven to be particularly useful in production lines in which an already well-established CMP process is installed and the deviation from substrate to substrate within a defined plurality is well within the acceptable process parameters. Accordingly, process control can be carried out on a lot-to-lot basis for a large number of substrates in a simple, yet efficient manner.

In one embodiment, as shown in FIG. 1, the controller 150 performing a control operation according to one of the illustrative embodiments described with reference to FIGS. 2-4 comprises an input section 151, a calculation section 152 and an output section 153, wherein the input section 151 is operatively connected to the metrology tool 130 and the output section 153 is operatively connected to the CMP tool 110. When the CMP process is to be controlled on a substrate-to-substrate basis, the metrology tool 130 and the controller 150 are implemented as inline equipment so as to minimize transportation of the substrates and accelerate input of measurement results into the input section 151. In a further embodiment, preferably when a plurality of substrates is controlled by a mean value for the overpolish time and/or the platen III polish time for the plurality, the metrology tool 130 and/or the controller 150 may be provided outside the production line.

The controller 150 may be implemented as a single chip microprocessor, as a microcontroller having inputs to which analogous or digital signals may directly be supplied from the metrology tool 130, or may be part of an external computer, such as a PC or a work station, or it may be a part of a management system in the factory as is commonly used in semiconductor fabrication. In particular, the calculation steps 220 and 230 may be performed by any numerical algorithms including an analytical approach for solving the involved equations, fuzzy logic, use of parameters in tables, especially for the EWMA, and corresponding operation codes may be installed in the controller 150. Moreover, the above-described embodiments may easily be adapted to any known CMP tool since it is only necessary to obtain the sensitivity parameters a and/or P, which describe the inherent properties of the corresponding CMP tool and the basic CMP process performed on this tool.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method of controlling a chemical mechanical polishing of substrates, the method comprising:

obtaining a first sensitivity parameter quantitatively describing a relationship between an overpolish time for a first material layer and a control variable related to the first material layer;

obtaining a second sensitivity parameter quantitatively describing a relationship between a control variable related to a second material layer and a control variable related to a second material layer of a preceding substrate;

calculating the overpolish time of the first material layer from a linear model of the chemical mechanical polishing process, wherein the model at least includes the control variable related to the second material layer, the first sensitivity parameter, the second sensitivity parameter, a command value for the first material layer, the overpolish time of the second material layer, the control variable related to the second material layer, and the control variable related to the second material layer of the preceding substrate;

calculating a weighted moving average of the overpolish time of the first material layer; and adjusting the overpolish time for the first material layer during the chemical mechanical polishing of the substrate corresponding to the calculated overpolish time.

2. The method of claim 1, wherein said control variables represent at least one of erosion, dishing and material layer thickness.

3. The method of claim 1, further comprising determining at least one of erosion, dishing and layer thickness by measurement of at least one of the first and second material layers of the preceding substrate.

4. The method of claim 1, wherein each of the control variables represents a mean value for a plurality of substrates.

5. The method of claim 1, wherein the first sensitivity parameter depends on at least one of the number of substrates that have been processed and the number of substrates that are to be processed.

6. The method of claim 1, wherein the chemical mechanical polishing process comprises a final polishing step carried out on a separate polishing platen with an adjustable extra polish time.

7. The method of claim 6, further comprising obtaining a third sensitivity parameter quantitatively describing a relationship between the control variables and said extra polish time.

8. The method of claim 7, further comprising calculating said extra polish time from said linear model.

9. The method of claim 8, wherein calculating the overpolish time and the extra polish time includes determining an intermediate overpolish time and an intermediate extra polish time such that a combined deviation of the intermediate overpolish time and the intermediate extra polish time from a central point of a corresponding allowable range is approximately a minimum.

10. The method of claim 9, wherein said minimum is determined under the condition that the intermediate overpolish time and the intermediate extra polish time change in a different direction when compared to the respective values of the preceding substrate and under the condition that the intermediate overpolish time and the intermediate extra polish time create a control variable value related to the first material layer that is substantially equal to said command value.

11. A method of controlling a chemical mechanical polishing of a first metallization layer in a substrate, the method comprising:

determining a sensitivity parameter ax that quantitatively describes an effect of an overpolish time $T_{op}$ used in the CMP after an endpoint is detected on a control variable $E_{first}$ related to the first metallization layer;

determining a sensitivity parameter $\alpha$ that quantitatively describes an effect of a control variable $E_{second}$ related to a second metallization layer of the substrate and a control variable $E_{p,second}$ related to the second metallization layer of a preceding substrate on the control variable $E_{first}$ wherein the index p indicates a variable referring to a preceding substrate; and calculating the overpolish time $T_{op}$ for the first metallization layer from a linear model that at least includes the following terms:

$$E_{first},\ E_{p,first},\ \alpha(T_{op}-T_{p,op}),\gamma(E_{second}-E_{p,second}),$$

wherein $T_{p,op}$ is the overpolish time of the preceding substrate; and selecting the calculated overpolish time $T_{op}$ as the actual overpolish time during the chemical mechanical polishing of the first metallization layer of the substrate.

12. The method of claim 11, wherein calculating $T_{op}$ includes calculating an intermediate overpolish time $T_{op}$* that would be needed to obtain a desired value $E_{target}$ of the control variable $E_{first}$; and calculating $T_{op}$ as a weighted moving average from the overpolish time of the preceding substrate $T_{p,op}$ and said intermediate overpolish time $T_{op}$*.

13. The method of claim 12, wherein said weighted moving average is an exponentially weighted moving average.

14. The method of claim 11, wherein each of said control variables represents a mean value of a plurality of substrates.

15. The method of claim 11, wherein each of said control variables represents one of erosion, dishing and layer thickness of the first and second metallization layers.

16. The method of claim 11, further comprising measuring the control variables of the preceding substrate and using the measured value of the control variable for calculating said overpolish time $T_{op}$.

17. The method of claim 12, wherein a loss of validity of the linear model is indicated when the intermediate overpolish time is outside of a predefined value range.

18. The method of claim 11, wherein the chemical mechanical polishing process comprises a final polishing step carried out on a separate polishing platen, whereby a process time of the final polishing step is used as a manipulated variable indicated as $T_{III}$.

19. The method of claim 18, further comprising determining a sensitivity parameter $\beta$ quantitatively describing an effect of the final polish time $T_{III}$ on the control variable $E_{first}$.

20. The method of claim 19, wherein said linear model further includes the term:

$$\beta(T_{III}-T_{p,III}),$$

wherein $T_{p,III}$ represents the final polish time of the preceding substrate, and wherein the overpolish time $T_{op}$ and the final polish time $T_{III}$ are calculated from the model including said term.

21. The method of claim 20, wherein said model is given by:

$$E_{first}=E_{p,first}+\alpha(T_{op}-T_{p,op})+\beta(T_{III}-T_{p,III})+\gamma(E_{second}).$$

22. The method of claim 21, further comprising calculating an intermediate overpolish time $T_{op}$* and an intermediate final polish time $T_{III}$* prior to calculating said overpolish time $T_{op}$ and said final polish time $T_{III}$.

23. The method of claim 22, wherein the intermediate overpolish time and the intermediate final polish time are calculated under the secondary condition that $T_{op}$* and $T_{III}$* are selected so as to substantially yield the desired value $E_{target}$ while a sum of deviations of $T_{op}$* and $T_{III}$* from respective central points in the predefined value range for $T_{op}$* and $T_{III}$* is minimized.

24. The method of claim 23, wherein $T_{op}$* and $T_{III}$* are calculated under the secondary condition that $T_{op}$* is equal or less than the overpolish time of the preceding substrate and $T_{III}$* is equal or greater than the final polish time of the preceding substrate when $E_{p,first}+\gamma(E_{second}-E_{p,second})$ is greater than the desired value $E_{target}$.

25. The method of claim 23, wherein $T_{op}$* and $T_{III}$* are calculated under the secondary condition that $T_{op}$* is equal or less than the overpolish time of the preceding substrate and $T_{III}$* is equal or greater than the extra polish time of the preceding substrate when $E_{p,first}+\gamma(E_{second-Ep,second})$ is less than the desired value $E_{target}$.

26. The method of claim 21, wherein the overpolish time $T_{op}$ and the final polish time $T_{III}$ are calculated as weighted moving averages, respectively.

27. The method of claim 20, further comprising measuring the control variables of the preceding substrate.

28. The method of claim 11, wherein the sensitivity parameter $\alpha$ depends on at least one of the number of substrates to be processed and the number of substrates that have been processed.

29. The method of claim 21, wherein the sensitivity parameter $\beta$ depends on at least one of the number of substrates to be processed and the number of substrates that have been processed.

* * * * *